United States Patent [19]

Bédier

[11] 4,445,345

[45] May 1, 1984

[54] PANTY-HOSE WITH AN ELASTIC BELT INCORPORATED THEREIN AND METHOD

[75] Inventor: Pierre C. A. Bédier, Moreuil, France

[73] Assignee: Societe Breilly S.A., Moreuil, France

[21] Appl. No.: 233,115

[22] Filed: Feb. 10, 1981

[30] Foreign Application Priority Data

Feb. 20, 1980 [FR] France ..... 80 03672

[51] Int. Cl.[3] ..... A41B 9/02

[52] U.S. Cl. ..... 66/177; 2/409; 66/172 E

[58] Field of Search ..... 66/177, 172 E; 2/409

[56] References Cited

U.S. PATENT DOCUMENTS

| | | | |
|---|---|---|---|
| 2,349,746 | 5/1944 | Morris et al. | 66/172 E |
| 3,748,870 | 7/1973 | Fregeolle | 66/177 |
| 3,785,178 | 1/1974 | Machacek et al. | 66/196 |
| 3,924,423 | 12/1975 | Lonari | 66/172 E |
| 3,999,406 | 12/1976 | Boeckle et al. | 66/177 |
| 4,023,384 | 5/1977 | Conti et al. | 66/177 |
| 4,048,818 | 9/1977 | Cueman | 66/172 E |
| 4,150,554 | 4/1979 | Cassidy | 66/172 E |

FOREIGN PATENT DOCUMENTS

| | | | |
|---|---|---|---|
| 2392155 | 1/1979 | France | 66/177 |

*Primary Examiner*—Ronald Feldbaum

*Attorney, Agent, or Firm*—Gerald J. Ferguson, Jr.; Joseph J. Baker

[57] ABSTRACT

The present invention relates to a process for making mesh tights or panty-hose, with seam and elastic belt incorporated therein, and to tights obtained thereby. Over the height of the elastic belt, in a strip of about 2 cm width on either side of the slit made for joining two hose elements by a seam, an elastic yarn is knitted with one needle out of two, on the needles of the strip with the exception of the central needle, then the basic yarn is knitted on all the needles of the circular machine used, the hose elements are slit along the wale of the central needle and are joined by a seam.

7 Claims, 5 Drawing Figures

PANTY-HOSE WITH AN ELASTIC BELT INCORPORATED THEREIN AND METHOD

BACKGROUND OF THE PRESENT INVENTION

Figure 1:
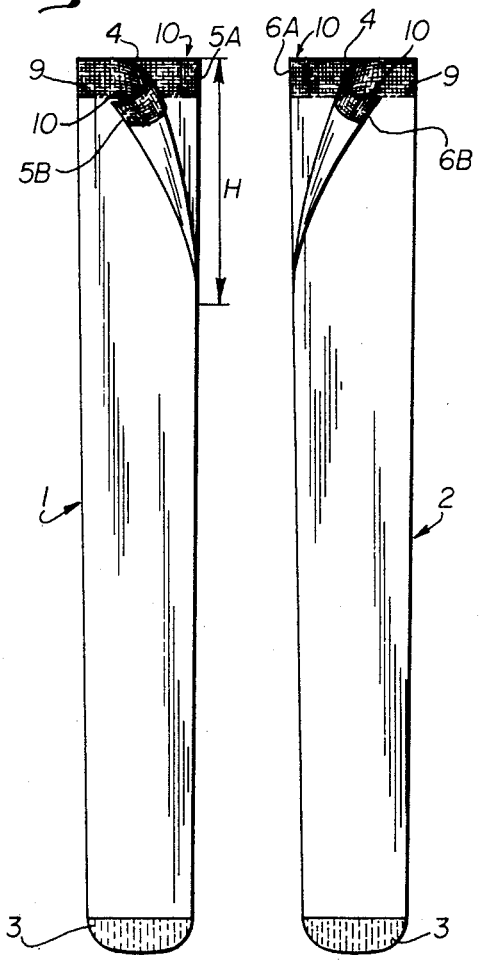

The present invention relates to a process for a making knitted tights or panty-hose composed of two halves which are joined by a seam passing from the belt to the crutch and which also comprises an elastic belt incorporated therein.

Incorporated elastic belt refers here to a belt knitted at the same time as the tights themselves, by opposition to the frequently employed method consisting in sewing a separate elastic tape to the top edge of the tights.

In tights where the belt is made in one piece by circular knitting, said belt may be easily rendered elastic by using an elastic yarn added to the basic yarn.

The situation is quite different when the tights are composed of two pieces which are joined by a seam from the front top edge of the belt to the rear top edge, via the crutch. In this case, two hose elements are knitted separately, each having the total length of the tights and each representing a leg plus the height of the panty up to the top edge of the belt. These two hose elements are advantageously obtained by using a circular knitting machine. Each is then slit along a generatrix from the top edge over the desired height of the panty. The corresponding edges of the two slits are joined and sewn together respectively to obtain a pair of tights with a seam.

If an elastic yarn is incorporated in the top part of each of the two hose elements, it slips and ladders when said hose elements are slit has just been explained.

Two solutions have been proposed up to the present time to remedy this situation. In published German Application No. 1 785 346, it is envisaged to knit an elastic yarn with a basic yarn over the whole perimeter of the belt, alternately one wale out of two. In practice, the elasticity of a belt made in this way is observed to be insufficient. French Patent No. 70-00922 (2 076 342) envisages knitting the elastic yarn with the basic yarn in a zone of width limited to a few wales which are all immediately adjacent one another. When each hose element is then slit, the line of cut is not always well centred the edges are not neat and it happened that the elastic yarn slips.

It is a principal object of the invention to provide another solution which differs from the solutions described in these patents and which is advantageous from the standpoint of slitting the hose elements and anchoring the elastic yarn.

In the present case, a double-cylinder double feed half-hose knitting machine is used, of the type comprising a conventional welt bolt cam and a Jacquard system.

Each half-hose is knitted in tubular form, beginning at the top welt, using the basic yarn chosen (made of synthetic or natural material or a blend) and, in addition to the basic yarn, an elastic yarn is used which is introduced for example in each course of stitches over a height depending on the size of the finished article. In a vertical strip with a width of about 2 cm which concerns a number of needles between 12 and 24, the elastic yarn is knitted alone with the needles of the bottom cylinder except the central needle of this strip which is left in rest position, and only over the chosen width, the other needles of the bottom cylinder being left in rest position, and all the needles of the top cylinder also being left in rest position.

At the following feed, the basic yarn alone is used as usual, with all the needles of the two cylinders.

This operation is continued in this way alternately over the whole height of the elastic belt and after having made said belt, normal knitting is effected up to the tip using the basic yarn on the two feeds, i.e. at each yarn distribution.

The two hose elements thus being produced, each may be cut to form a slit over a height which corresponds to that of the panty, by cutting the yarns at the centre of the vertical strip, corresponding to the location of the central needle left in rest position when the elastic yarn was being knitted. The latter is blocked by the manner in which it was knitted and it does not run. The two hose elements are then sewn together by a flat or overcast seam along the two edges of the slits, and the desired tights are obtained.

The invention also relates to any tights or pantyhose made according to the above method; such tights are recognized from the vertical strip which extends on either side of the flat seam over the height of the elastic belt incorporated therein. The appearance of this strip necessarily differs from the appearance of the adjacent and lower parts of the tights.

On these tights, before the slit is cut and the seam is made, in a strip a few centimeters wide, and over the height of the elastic belt, the elastic yarn is knitted partially, one wale out of two, with the exception of the central wale where the yarn is floated. On the finished tights, the seam is at the centre of this strip, where the central wale was located.

Figure 4:
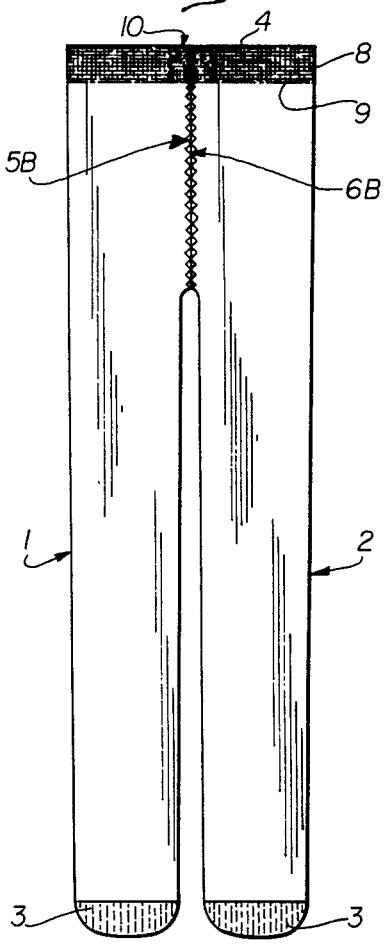
Figure 2:
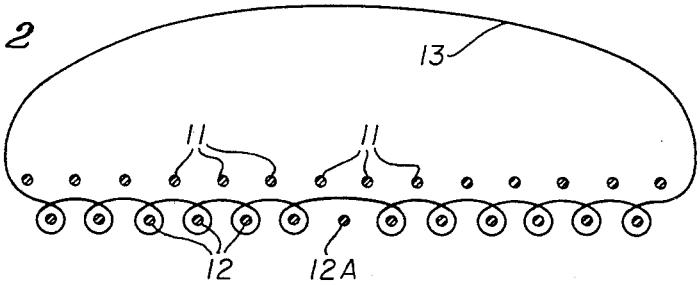
Figure 3:
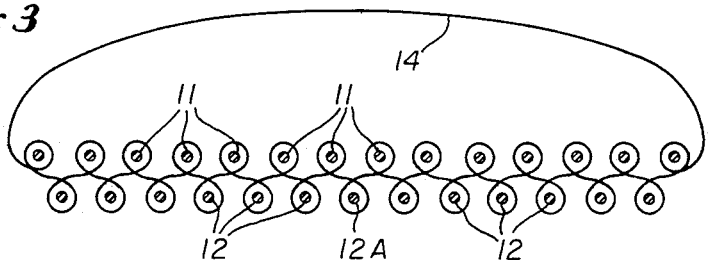
Figure 5:
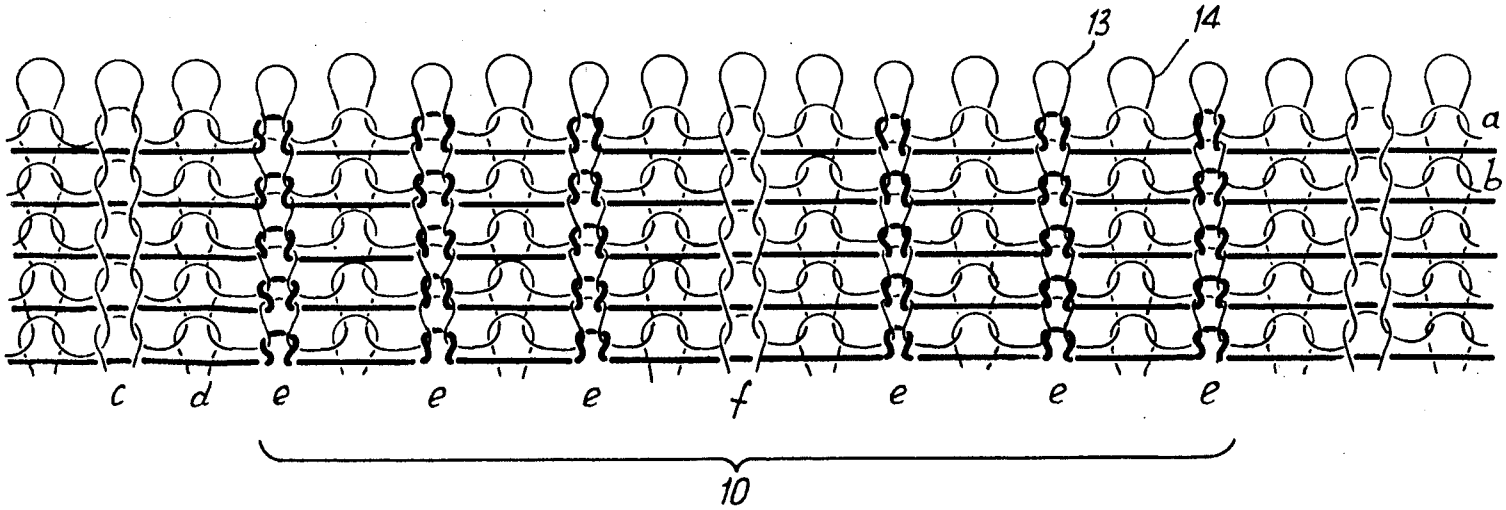

The invention will be more readily understood on reading the following description with reference, to the accompanying drawings, in which:

FIG. 1 is a view schematically showing the mode of making tights, according to the process of the invention, FIG. 2 is a diagram showing the needles used for knitting the elastic yarn in the strip provided over the height of the elastic belt for the slit of each hose element, FIG. 3 is a diagram similar to FIG. 2 showing the use of the same needles for knitting the basic yarn, FIG. 4 is a view of a finished pair of tights according to the invention, FIG. 5 is a diagram showing the stitches made according to the invention in the strip to be cut and joined by a seam.

Referring now to the drawing, the process of the invention may be used for making supple and stretchable mesh tights or panty-hose, from two elongated hose elements 1, 2 cylindrical over the whole of their length. These hose elements are obtained from a basic yarn of which the nature is not imposed by the invention; this may be a yarn of natural or synthetic material, or a blend. The size of the yarn is not imposed by the invention.

For the present embodiment, a cylindrical half-hose knitting machine has been used, having a top cylinder with needles, a bottom cylinder with needles, a welt bolt cam associated with the top cylinder and a Jacquard system associated with the bottom cylinder. This machine had a gauge of 18 and two feeds, or distribution of yarn, per revolution.

Each hose element 1, 2 is knitted from a top end 4 which remains open, up to a lower end or tip 3 which is closed. When each hose element 1, 2 has been finished, it is slit over a height H which corresponds to the length of the panty between the crutch and the waist. An open slit having two edges 5A, 5B and 6A, 6B respectively on hose element 1 and hose element 2 is obtained. To obtain the finished tights, as shown in FIG. 4, the edges 5A–6A and 5B–6B are sewn together by a flat or overcast seam 7 starting from a point on the front top edge to reach the opposite point on the rear top edge via the crutch.

These tights are provided with an elastic belt 8 incorporated therein, which is located between the upper edge of the top open end 4 and a lower limit indicated by a dashed and dotted line 9 in FIG. 4. The actual height of the elastic belt 8 is chosen as a function of the size or, more exactly, of the waist size of the tights made.

Between the lower limit indicated by the dashed and dotted line 9 of the elastic belt 8 and the tip or lower end 3, each hose element is knitted with one basic yarn. Between the upper edge or welt 4 and the dashed and dotted line 9, an appropriate elastic yarn, known per se in this domain, is used in addition to the basic yarn, and one and the other yarn are alternately used, feed by feed, over the whole height of the elastic belt.

According to the method of the invention, in a vertical strip designated by reference 10, a special operation is carried out over the whole height of the elastic belt 8. In FIG. 1, this strip 10 is divided into two by the slit which must precisely be made in the centre of this strip 10.

The width of the strip 10 corresponds to the space occupied by a certain number, between 12 and 24 and preferably between 14 and 22, of adjacent needles, on the top cylinder and on the bottom cylinder. This width is about 2 cm with a gauge 18.

FIGS. 2 and 3 each show a diagram of fourteen needles 11 of the top cylinder and thirteen needles 12 of the bottom cylinder.

When, for a course of stitches, an elastic yarn 13 is employed in the width of the strip 10, the needles 11 of the top cylinder are immobilised in rest position with the aid of the welt bolt cam on the machine used here, all the needles of the bottom cylinder are also placed out of service except the needles 12 which are actuated except for a central needle 12A which is placed out of service, with the aid of the Jacquard system of the machine.

When, for the following course of stitches, the basic yarn 14 is used (FIG. 3), all the needles of the two cylinders, including needle 12A, are normally used.

Such alternating operation is continued in this way over the whole height of the elastic belt 10. When the latter is terminated, knitting is effected with the basic yarn alone, on the two feeds, as before, to finish the hose element.

At that time, over the height of the elastic belt, the strip 10 is as shown partially and schematically in FIG. 5. The basic yarn 14, drawn in a thin line, is knitted in all the courses and in all the wales; in wales c the meshes are on the face side, in wales d they are on the back side. In one wale out of two (wales e), the elastic yarn 13 drawn in a thick line is knitted with the basic yarn 14, except in the central wale f (which corresponds to needle 12A). In the intermediate wales between the wales e and wale f, the elastic yarn 13 is floated and the basic yarn 14 is knitted alone. The central wale f where the elastic yarn 13 is floated is clearly visible on the knitted fabric and serves as cutting line.

When the two hose elements are finished, they are each slit longitudinally, as explained herein above, by cutting along the wale f, at the easily locatable site of the needle 12A which did not serve when the elastic yarn 13 was knitted. The latter is blocked by the process carried out; it does not slip and does not ladder. By knitting this elastic yarn 13 one wale out of two, its ends are well anchored. The seam 7 may then be made to obtain the finished tights as shown in FIG. 4.

In the embodiment described hereinabove, it has been assumed that the tights were made in single (1/1) rib and that the elastic yarn was introduced as a weft filling yarn, one feed out of two. This modus operandi is not imposed by the invention. The process enables the tights to be made in 2/1, 2/2/, 3/1 or Derby rib and in any fancy stitch or Jacquard design. Similarly, it is not necessary to use in the elastic belt an elastic yarn introduced one feed out of two. A feature of the invention is that, over the width of a strip 10 as defined hereinabove, the elastic yarn 13 is knitted separately with the needles of one cylinder with the exception of the central needle, whilst, between the courses of elastic yarn, the basic yarn 14 is knitted with all the needles of the two cylinders.

It is also clear that the method of the invention may be carried out with machines other than a half-hose machine with two yarn feeds per revolution. Larger machines for making tights, with several feeds per revolution, may also be used. There are no particular difficulties involved in adapting the process to these machines.

A pair of tights or panty-hose made according to the invention is recognizable by the existence of a strip of limited height which exists in the elastic belt, at the rear and front of the tights, and at the centre of which the seam 7 passes. This strip 10 is easily distinguished, by its different appearance, from the rest of the tights.

I claim:

1. Mesh tights or panty-hose made from two knitted hose elements, slit and joined by a seam, with an elastic belt incorporated therein constituted by an elastic yarn added to the basic yarn, in which the elastic yarn is floated over a large fraction of its length, wherein before the slit and seam are made the elastic yarn is partially knitted one wale out of two at each course over the height of the elastic belt, in a strip a few centimeters wide, with the exception of the central wale where the elastic yarn is floated, at the centre of which strip is located the seam on the finished tights which corresponds to the location of the central wale.

2. The tights of claim 1, wherein the strip where the elastic yarn is partially knitted has a width of about 2 cm corresponding according to the gauge to a number of needles of between 12 and 24.

3. Process for making tights from two hose elements knitted separately on a circular machine with two cylinders of needles, namely a top cylinder and a bottom cylinder, with an elastic belt incorporated therein constituted by an elastic yarn added to the basic yarn, these hose elements being slit by a cut then joined by a seam, whereby the elastic yarn is floated over a large fraction of its length, said process comprising the following steps, for a strip having a width of a few centimeters:

knitting the elastic yarn alone with the needles of the bottom cylinder except the central needle of this strip which is left in rest position, the other needles of the bottom cylinder being left in rest position and all the needles of the top cylinder also being in rest position, knitting the basic yarn alone with all the needles of the top cylinder and of the bottom cylinder, periodically repeating these operations over the whole height of the elastic belt and terminating the hose element with the basic yarn alone knitted normally with the needles of the two cylinders, cutting each hose element along the wale which corresponds to the central needle where the elastic thread was not knitted.

4. The process of claim 3, wherein, by knitting the elastic yarn alone, the needles of the top cylinder are immobilised in rest position with the aid of the welt bolt cam of the machine and the needles of the bottom cylinder with the exception of the central needle, with the aid of the Jacquard system of the machine.

5. The process of claim 3, wherein, on a double-feed machine and for tights knitted in single rib, over the height of the elastic belt, the elastic yarn is used for one feed, then the basic yarn for the following feed, alternately.

6. The process of claim 3, wherein, for a machine of gauge 18, the strip has a width which corresponds to a number of needles between 12 and 24, and preferably between 14 and 22.

7. Mesh tights or panty-hose obtained by carrying out the process of claim 3, these tights having over the height of the elastic belt a strip at the centre of which passes the seam joining the two hose elements which form the tights, this strip differing in appearance, over a width of about 2 cm, from the rest of the tights.

* * * * *